US005586496A

United States Patent [19]

Shinohara et al.

[11] Patent Number: 5,586,496

[45] Date of Patent: Dec. 24, 1996

[54] DOT LINE PRINTER WITH ADJUSTED DOT POSITIONS FOR CANCELING SHEET FEED ERROR

[75] Inventors: Makoto Shinohara; Yoshikane Matsumoto; Shigenori Suematsu, all of Hitachinaka, Japan

[73] Assignee: Hitachi Koki Co., Ltd., Tokyo, Japan

[21] Appl. No.: 348,887

[22] Filed: Nov. 28, 1994

[30] Foreign Application Priority Data

Nov. 26, 1993 [JP] Japan ..... 5-297007

[51] Int. Cl.[6] ..... B41J 2/255

[52] U.S. Cl. ..... 101/93.04; 400/124.28

[58] Field of Search ..... 400/124, 124 TA, 400/124.28; 101/93.04, 93.05; 347/40, 42

[56] References Cited

U.S. PATENT DOCUMENTS

| | | | |
|---|---|---|---|
| 4,219,822 | 8/1980 | Paranjpe | 347/42 |
| 5,241,904 | 9/1993 | Kobayashi et al. | 101/93.04 |
| 5,263,782 | 11/1993 | Yagata et al. | 101/93.04 |

FOREIGN PATENT DOCUMENTS

| | | | |
|---|---|---|---|
| 58-199166 | 11/1983 | Japan | 347/40 |
| 05-138936 | 6/1993 | Japan | 347/40 |
| 06-238917 | 8/1994 | Japan | 400/124.28 |

OTHER PUBLICATIONS

"Electronic Servo for Image Printing on a Serially Operated Transducer/Spot Matrix Printer"; Kuhn, L.; IBM TDB, vol. 16, No. 5, Oct. 1973.

*Primary Examiner*—David A. Wiecking

*Attorney, Agent, or Firm*—Sughrue, Mion, Zinn, Macpeak & Seas

[57] ABSTRACT

In a dot line printer that prints, for example, eight lines of dots with each single scan of a hammer bank, wherein the pins of hammers for printing the first dot line and the eighth dot line or for printing the second dot line and the seventh dot line are shifted from their respective home positions to compensate for an error causing impressions of dots to be made at an unequal pitch in a sheet feed direction as a result of consecutive forward and backward movements of the hammer bank.

9 Claims, 5 Drawing Sheets

DOT LINE PRINTER WITH ADJUSTED DOT POSITIONS FOR CANCELING SHEET FEED ERROR

BACKGROUND OF THE INVENTION

1. Field of the Invention

The present invention relates to a dot line printer having a reciprocally movable hammer bank wherein a predetermined number of dot lines are printed with each of forward and backward movements of the hammer bank and printing of one character line is completed by reciprocating the hammer bank a predetermined number of times.

2. Description of the Related Art

FIG. 1 shows a conventional dot line printer. In this printer, continuous print paper 4 is used which is provided with uniformly-spaced perforations which are drivingly engaged by a sheet feed mechanism such as a pin feed tractor 5 to intermittently move the paper 4 in a sheet feed direction F. A platen 7 is rotatably supported on a printer frame (not shown) for supporting the print paper 4.

The hammer bank 1 is reciprocally movably supported in a printer housing (not shown) and is in confrontation with the paper 4. The hammer bank 1 accommodates therein a plurality of dot print hammers juxtaposed at an equi-distant pitch along a line extending in a columnar direction C perpendicular to the sheet feed direction F. The print hammer is in the form of an elongated leaf spring having an upper end to which a pin is attached for making an impression of a dot on the print paper 4 through an inking ribbon. The pins of the print hammers are displaced at an equi-distant pitch in the sheet feed direction F so that an N-number (N being an integer) of dot lines are printed with each of forward and backward movements of the hammer bank 1. The print paper 4 is fed intermittently by an amount corresponding to the N-dot lines in the paper feed direction F upon completion of printing of N-dot lines.

The inking ribbon 3 is transported by a ribbon transport mechanism 6 and passes between the print paper 4 and the hammer bank 1. The inking ribbon 3 is moved in the columnar direction C in the portion between the print paper 4 and the hammer bank 1. A drive mechanism (not shown) for driving the print hammers is housed in the hammer bank 1.

A shuttle mechanism 2 is provided for reciprocally moving the hammer bank 1 in the columnar direction C. The shuttle mechanism 2 includes a shuttle motor and a cam 2. To print dot matrix characters or graphics on the print paper 4, the print hammers are selectively driven by the drive mechanism while the hammer bank 1 is reciprocated with forward and backward movements by the shuttle mechanism 2 across the print paper 4.

When the hammer bank 1 makes one way movement, e.g. from the leftmost and to the rightmost end of the hammer bank reciprocating path, N-number of dot lines are printed simultaneously. Upon printing the first N-number of dot lines, the print paper 4 is fed N-number of dot lines in the sheet feed direction F. Then the hammer bank 1 moves backwardly from the rightmost and to the leftmost end. During the backward movement of the hammer bank 1, another N-number of dot lines are printed. This procedure is repeated until desired characters or graphics are printed. The movement of the hammer bank 1 from one end (for example, the rightmost end) to the opposite end (for example, the leftmost end) or vice versa, will hereinafter be referred to as "one scan".

Next, a method of printing a character with the line printer shown in FIG. 1 will be described while referring to FIG. 2. In this example, 8 dot lines can be printed simultaneously with each scan of the hammer bank 1 and the character is expressed by a 24-by-24 dot matrix having 24 dot printable positions in row and column. Therefore, three scans are required to complete printing of one character line. More specifically, during the first scan of the hammer bank 1 moving, for example, rightward, let through 8th dot lines of a first character line are printed. While the hammer bank 1 is reversing at the rightmost end of the hammer bank moving path, the print paper 4 is fed an amount corresponding to eight dot lines. During the second scan of the hammer bank 1 moving leftward, 9th through 16th dot lines are printed. During the hammer bank reversing time at the leftmost end, the print paper 4 is again fed an amount corresponding to eight dot lines. Thereafter, 17th through 24th dot lines are printed during the third scan. This finishes printing of the first character line. The direction of the hammer bank 1 is then reversed and the hammer bank 1 returns to the leftmost end from which printing of the first scan of the first character line starts. During the interval the hammer bank 1 returns to the initial position, the print paper 4 is fed to reserve an interline space between two successive character lines. Printing is performed by repeating the above-described sequence of processes.

In the dot line printer of the type as described above wherein a predetermined number of dot lines are printed simultaneously with each scan of the hammer bank 1, the pins of the print hammers are arranged at a predetermined equi-distant pitch in the sheet feed direction F. To make an impression of two continuous dots of, for example, 1/168 inch in the sheet feed direction F, the pins of the print hammers must be arranged at an equi-distant pitch of 1/168 inches in the sheet feed direction F. Therefore, the precision of dot positions in the sheet feed direction F printed during the same scan of the hammer bank, for example, the precision of the dot positions printed on the 1st through 8th dot lines, is determined solely by the precision in the arrangement of the print hammer pins in the sheet feed direction F.

However, in the 8-dot-line printable hammer arrangement, the space between the dots in the eighth dot line of the first scan and the dots in the first dot line of the second scan is determined not only by the positions of the print hammer pins arranged in the sheet feed direction F but also an accumulative error of the sheet feed deviation and an operational difference between forward and backward movements of the hammer bank 1 by the shuttle mechanism 2. Accumulative error can produce greater variation than the precision at which dot print hammers are positioned, but is mechanically unavoidable. Therefore, ensuring accurate positioning between printed dots of different scans is difficult using conventional technology.

FIG. 3 shows a dot pattern produced by two perfectly executed scans (i.e., with zero accumulative error) wherein N-number of dot lines are printed in each scan. As can be seen, all adjacent dot lines are separated by the same distance because a predetermined pitch is maintained between dot lines during both the sheet feed operation in the sheet feed direction F and the shuttle operation in the columnar direction.

FIG. 4 shows a dot pattern produced when the interval between the first scan and the second scan broadens (hereinafter referred to as "separation in the positive direction"). When this type of accumulative error occurs, the interval between the n-th dot line (n(dl)) of the first scan and the first dot line (1(d1)) of the second scan is greater than the predetermined pitch. This can cause a gap or white line to appear between printed dot lines.

FIG. 5 shows a dot pattern produced when the interval between the first scan and the second scan narrows (hereinafter referred to as "separation in the negative direction"). When this type of accumulative error occurs, the interval between the Nth dot line (N(d1)) of the first scan and the first dot line (1(d1)) of the second scan is less than the predetermined pitch. This can cause adjacent dot lines that should be separated to come in contact or overlap. In the situation shown in FIG. 5, even if the accumulative error is small, printed characters can appear squashed or the width of lines extending in the feed direction F can appear nonuniform.

SUMMARY OF THE INVENTION

It is therefore an object of the present invention to prevent poor appearance in the interval of print dot lines in the sheet feed direction even taking into account the accumulative error of sheet feed movement and shuttle movement between dot lines, thereby improving quality of the resultant print.

To achieve the above and other objects, there is provided a dot line printer which includes a hammer bank, a sheet feed mechanism and a shuttle mechanism. A hammer bank accommodates therein a plurality of print hammers which have pins for making impressions of dots on a sheet of paper. The pins of the plurality of print hammers have respective home positions displaced at an equi-distant pitch in a first direction (sheet feed direction) perpendicular to a second direction (columnar direction) in which the hammer bank reciprocates so that N dot lines are printable with each of forward and backward movements of the hammer bank where N is an integer equal to or greater than two.

In accordance with the invention, at least one of the pins for printing N dot lines is shifted from its home position to compensate for an error causing impressions of dots to be made at an unequal pitch in the first direction as a result of consecutive forward and backward movements of the hammer bank. The sheet feed mechanism feeds a sheet of paper in the first direction after the N dot lines are printed by each of forward and backward movements of the hammer bank, and produces an error causing dots to be made on the N-th dot line printed during forward movement of the hammer bank and dots on the first dot line printed during subsequent backward movement of the hammer bank. Therefore, at least one of the first pin for printing on a first dot line and an N-th pin for printing on an N-th dot line is shifted to be apart from each other. Preferably, both the first pin and the N-th pin are shifted by the same distance from their respective home positions.

In further accordance with the invention, at least one of an M-th pin for printing on an M-th dot line and an (N–M+1)th pin for printing on an (N–M+1)th dot line are shifted so that the M-th pin shifts toward an (M+1)th pin and the (N–M+1)th pin shifts toward an (N–M)th pin where N is equal to or greater than four and M is an integer equal to or greater than two and M is equal to or less than N/2.

In accordance with the invention, two types of pin shift as described above may be combined. Specifically, the first pin and the N-th pin may be shifted to be apart from each other, and at least one of the M-th pin and the (N–M+1)th pin may also be shifted so that the M-th pin shifts toward an (M+1)th pin and the (N–M+1)th pin shifts toward an (N–M)th pin.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
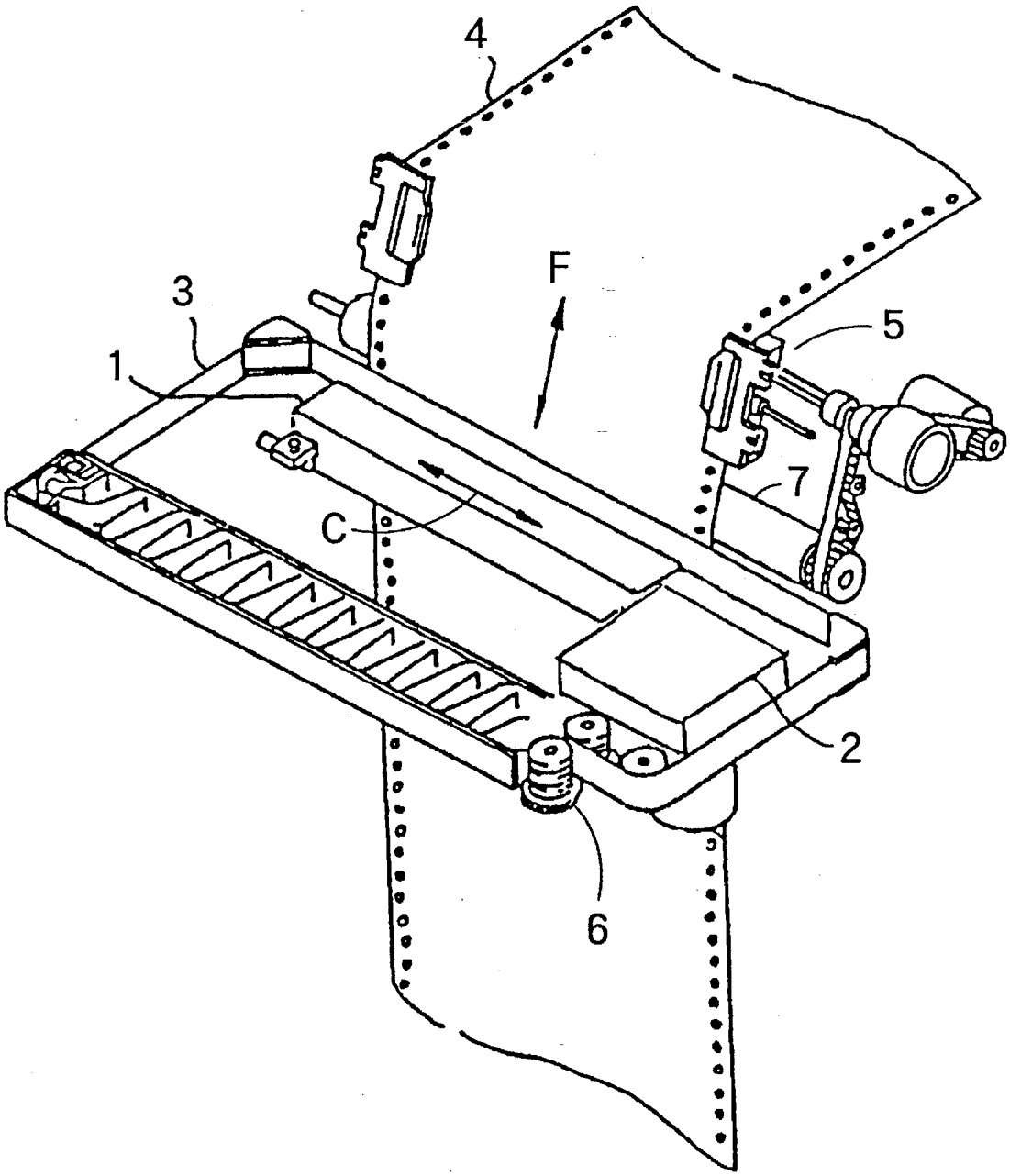
FIG. 1 PRIOR ART
FIG. 1 is a perspective view showing a conventional dot line printer.
Figure 2:
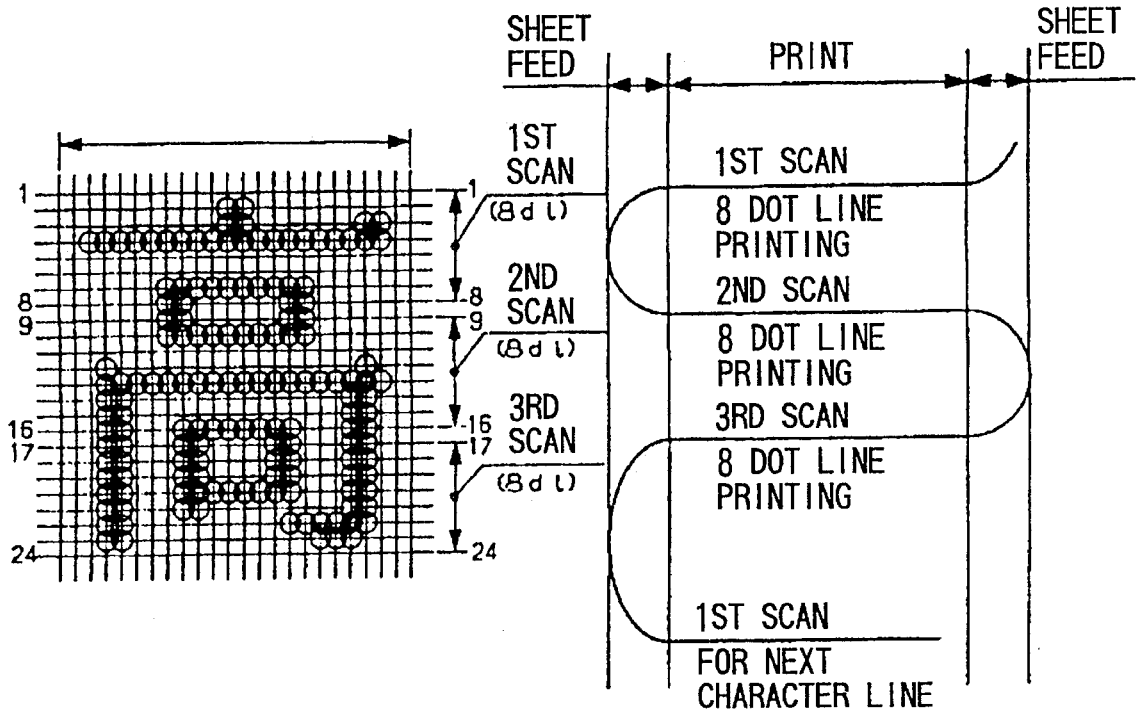
FIG. 2 PRIOR ART
FIG. 2 is an explanatory view showing method for printing a character by dot line printing techniques.
Figure 3:
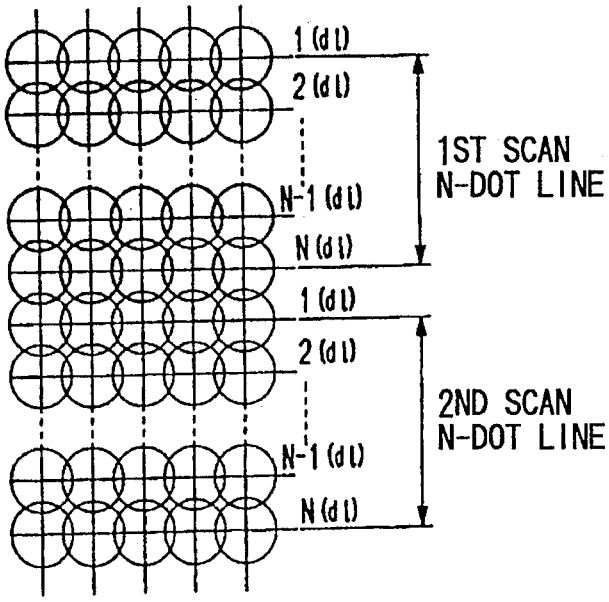
FIG. 3 PRIOR ART
FIG. 3 is an enlarged view showing relative positions of dots of the character shown in FIG. 2.
Figure 4:
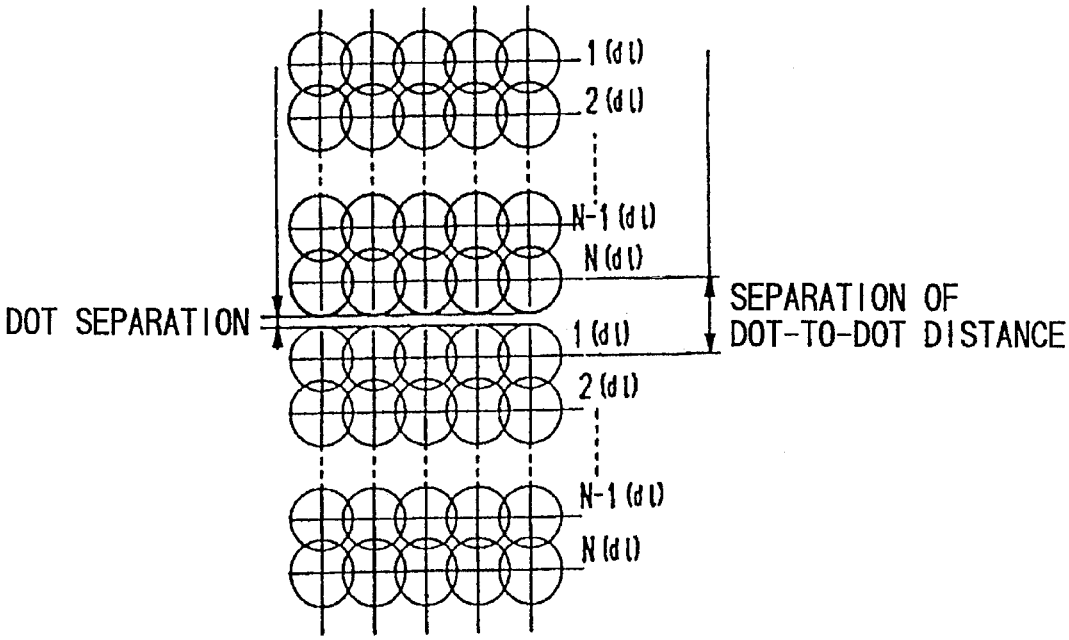
FIG. 4 PRIOR ART
FIG. 4 is an enlarged view showing relative positions of dots when accumulative error causes the interval between a first scan and a second scan to broaden.
Figure 5:
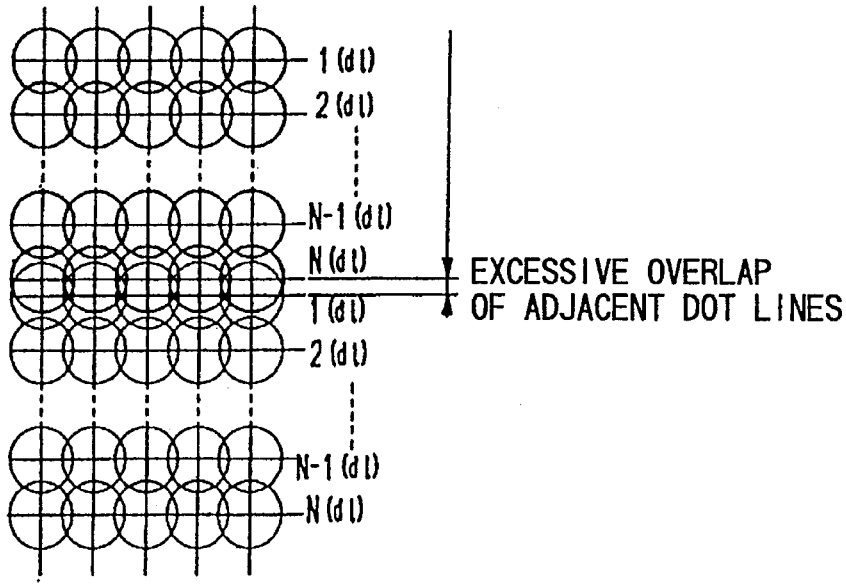
FIG. 5 PRIOR ART
FIG. 5 is an enlarged view showing relative positions of dots when accumulative error causes the interval between a first scan and a second scan to narrow.

A dot line printer according to preferred embodiments of the present invention will be described while referring to the accompanying drawings wherein like parts and components are designated by the same reference numerals to avoid duplicating description.

Figure 6:
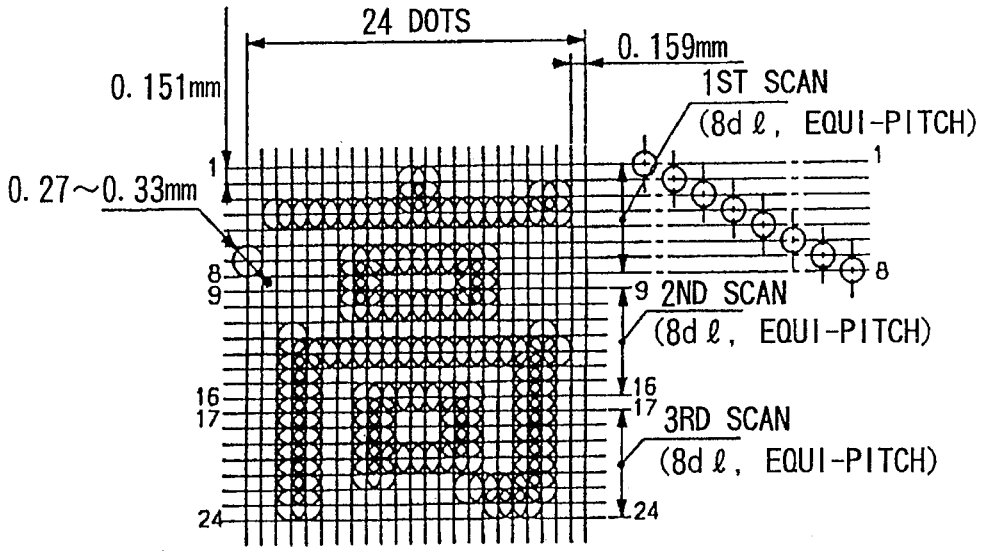
FIG. 6 is a representation of a character printed with a dot line printer.

FIG. 6 is a representation of a character printed with a print density of 160 dpi (dot per inch) in the horizontal direction and 168 dpi in the vertical direction. In 160 dpi a dot-to-dot distance is 0.159 mm, and in 168 dpi, 0.151 mm. In this example, each character line is 24 dots high, and is printed by scanning a hammer bank across the sheet three times, eight dot lines being printed per scan. Each printed to has a diameter in a range of 0.27 to 0.33 mm. Dots overlap 0.111 to 0.171 mm in the horizontal direction and 0.119 to 0.179 mm in the sheet feed direction. The diameter and overlap of printed dots vary depending on variation in diameter of print hammer dots and whether the inking ribbon is new or used. Precision of print hammer dot arrangement in the sheet feed direction which can print eight dot lines with each scan of the hammer bank is about +/–0.05 mm in the horizontal and sheet feed direction. Accumulative error in the sheet feed direction caused by sheet and shuttle movements between the first scan and the second scan is about +/–0.08 mm. The distance between the last dot line of the first scan and the first dot line of the second scan is involved with a positional error of +/–0.13 mm.

Figure 7:
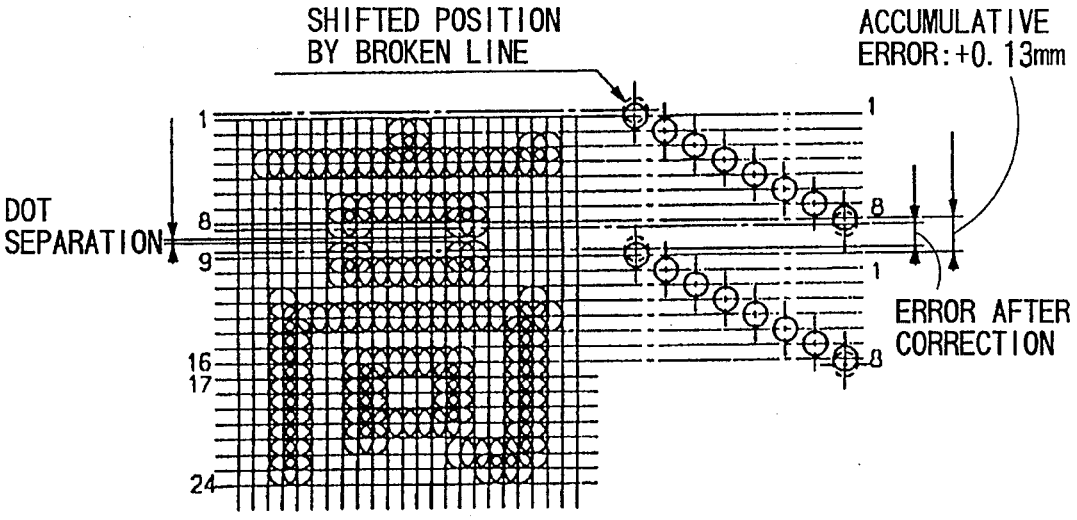
FIG. 7 is a comparison of a character printed with a conventional dot line printer and a dot line printer according to a first preferred embodiment of the present invention.

FIG. 7 shows a character printed at extremes of the above-described variations, that is, when dots are printed to the minimum size of 0.27 mm diameter and when the maximum accumulative error of +0.13 mm appears between dots in the eighth dot line printed during the first scan and the dots in the first dot line printed during the second scan. As can be seen in FIG. 7, dots in the eighth dot line printed during the first scan are separated from the dots in the first dot line printed during the second scan by about 0.011 mm, so that a white line is formed between the eighth dot line of the first scan and the first dot line of the second scan.

In a printer according to the first embodiment of the present invention, dot print hammers for printing the first and eighth dot lines are positioned 0.005 to 0.015 mm further apart from each other than when all dot print hammers are positioned in an equidistant alignment. Broken lines in FIG. 7 represent dots printed by a printer according to the first embodiment. As can be seen, the distance between dots in the eight dot printed during the first scan and dots in the first dot line printed during the second scan is reduced to about 0.01 to 0.03 mm so that separation of dots to an extent as to produce white lines can be prevented.

In the present embodiment, print hammer dots for the first and the eighth dot lines are displaced from their home positions by 0.005 to 0.015 mm. However, any value is acceptable for this separation distance as long as adjacent dots are printed so as to overlap within an allowable range.

Figure 8:
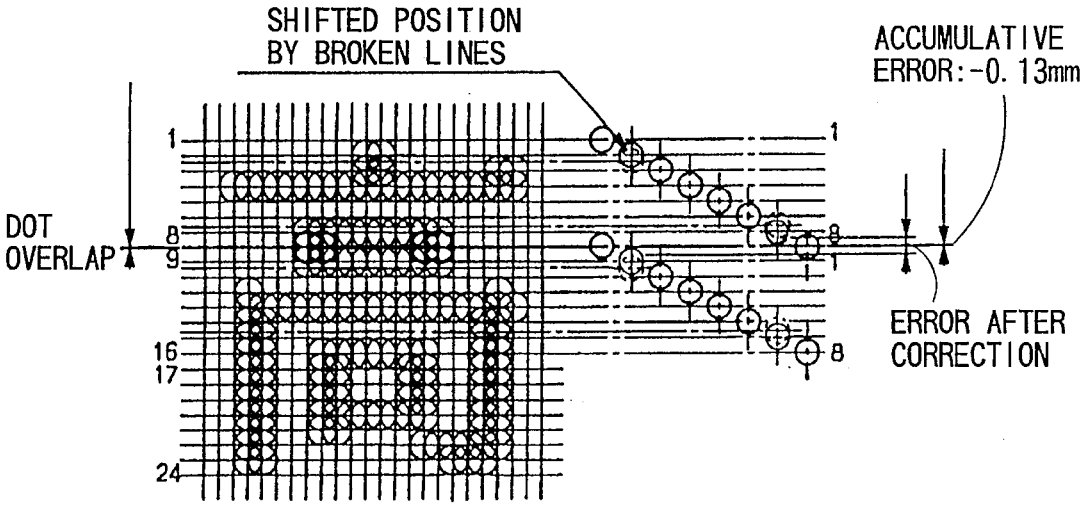
FIG. 8 is a comparison of a character printed with a conventional dot line printer and a dot line printer according to a second preferred embodiment of the present invention.

FIG. 8 shows a character printed at opposite extremes of the above-described variations, that is, when dots are printed to the maximum size of 0.33 mm diameter and when the minimum accumulative error of −0.13 mm appears between dots in the seventh dot line printed during the first scan and the dots in the second dot line printed during the second scan. As can be seen in FIG. 8, dots in the seventh dot line printed during the first scan overlap dots in the second dot line printed during the second scan by about 0.007 mm.

In a printer according to the second preferred embodiment of the present invention, print hammer dots for printing the second and seventh dot lines are positioned 0.015 to 0.02 mm closer to each other than when all dot print hammers are positioned in an equidistant alignment. Broken lines in FIG. 8 represent dots printed by a printer according to the second preferred embodiment. As can be seen in FIG. 8, dots in the seventh dot printed during the first scan and dots in the second dot line printed during the second scan are separated by 0.03 to 0.04 mm, thus preventing the dots in these two dot lines from overlapping.

Although the print hammer pins for printing the dots in the seventh dot line printed during the first scan and dots in the second dot line printed during the second scan are described above as being positioned so that the interval between adjacent hammers is within the range of 0.015 and 0.02 mm, any range is acceptable as long the range insures overlap of adjacent dots.

The measures described in the first and second preferred embodiments for inducing accumulative error in the positive direction and in the negative direction can be combined to provide further advantages.

As can be appreciated from the above description, dots printed in the sheet feed direction with the first scan of the hammer bank is not equi-distant but there exists a maximum shift of 0.06 to 0.07 mm in the sheet feed direction. However, this maximum shift yielded as a result of pin position adjustment is smaller than the accumulative error of +/−0.13 mm caused by the sheet feed operations and shuttle operations performed between the first scan and the second scan. As a result, error in the precision of the dot positions in the sheet feed direction is spread out so that overall quality of the printed characters improves.

Gaps between dots in the eighth dot line printed during the first scan and dots in the third dot line printed during the second scan, or between dots in the sixth dot line printed during the first scan and dots in the first dot line printed during the second scan may be the same or narrower than gaps when produced with uniformly spaced print hammer pins as in the conventional technology. However, the accumulative error caused by configuration of the mechanism that performs paper feed according to a given speed profile is generally concentrated in one direction. By analyzing the distributions of the printed dots that are extensively used or distributions of ruled lines and the like, a combination of the pin position adjustments according to the first and second embodiments affords good effects to dot lines that are frequently used.

Compared to conventional equi-distant arrangements of print hammer pins, widening or narrowing the pitch of selected print hammer pins and disorder in the resultant print in the sheet feed direction caused by the accumulative error is buffered so that the quality of print is improved.

While the invention has been described in detail with reference to specific embodiments thereof, it would be apparent to those skilled in the art that various changes and modifications may be made therein without departing from the spirit of the invention, the scope of which is defined by the attached claims.

What is claimed is:

1. A dot line printer comprising:

a hammer bank accommodating a plurality of print hammer which have pins for making impressions of dots on a sheet of paper, said pins of said plurality of print hammers having respective home positions displaced at an equi-distant pitch in a first direction perpendicular to a second direction in which said hammer bank reciprocates so that N dot lines are printable with each of forward and backward movements of said hammer bank where N is an integer equal to or greater than two, wherein at least one of said pins for printing N dot lines is shifted from its home position to compensate for an error causing impressions of dots to be made at an unequal pitch in the first direction as a result of consecutive forward and backward movement of said hammer bank.

2. A dot line printer according to claim 1, wherein at least one of a first pin for printing on a first dot line and an N-th pin for printing on an N-th dot line is shifted to be apart from each other.

3. A dot line printer according to claim 2, wherein both said first pin and said N-th pin are shifted by the same distance from their respective home positions.

4. A dot line printer according to claim 1, wherein at least one of an M-th pin for printing on an M-th dot line and an (N−M+1)th pin for printing on an (N−M+1)th dot line is shifted so that the M-th pin shifts toward an (M+1)th pin and the (N−M+1)th pin shifts toward an (N−M)th pin where N is an integer equal to or greater than two, M is an integer equal to or greater than two, and M is equal to or less than N/2.

5. A dot line printer according to claim 1, wherein a first pin for printing on a first dot line and an N-th pin for printing on an N-th dot line are shifted to be apart from each other, and at least one of an M-th pin for printing on an M-th dot line and an (N−M+1)th pin for printing on an (N−M+1)th dot line are shifted so that the M-th pin shifts toward an (M+1)th pin and the (N−M+1)th pin shifts toward an (N−M)th pin where M is an integer equal to or greater than two and M is equal to or less than N/2.

6. A dot line printer according to claim 5, wherein both said M-th pin and said (N−M+1)th pin are shifted from their respective home positions.

7. A dot line printer according to claim 5, wherein both said first pin and said N-th pin are shifted by a first distance from respective home positions of said first pin and said N-th pin, and said M-th pin and the (N−M+1)th pin are shifted by a second distance from respective home positions of said M-th pin and the (N−M+1)th pin.

8. A dot line printer according to claim 1, further comprising a sheet feed mechanism for feeding the sheet of paper in the first direction after the N dot lines are printed by each of forward and backward movements of said hammer bank, said sheet feed mechanism producing an error making dots on an N-th dot line printed during forward movement of said hammer bank and dots on a first dot line printed during subsequent backward movement of said hammer bank.

9. A dot line printer according to claim 1, further comprising a shuttle mechanism for reciprocally moving said hammer bank.

* * * * *